US008992810B2

(12) United States Patent
Schütt et al.

(10) Patent No.: US 8,992,810 B2
(45) Date of Patent: Mar. 31, 2015

(54) APPARATUS AND METHOD FOR GUIDING AND DEPOSITING SYNTHETIC FIBERS TO FORM A NONWOVEN WEB

(71) Applicant: Oerlikon Textile & GmbH & Co. KG, Remscheid (DE)

(72) Inventors: Günter Schütt, Neumünster (DE); Bernhard Potratz, Hamburg (DE); Hermann Leis, Esslingen (DE); Fabian Engel, Stuttgart (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 331 days.

(21) Appl. No.: 13/656,835

(22) Filed: Oct. 22, 2012

(65) Prior Publication Data

US 2013/0099409 A1 Apr. 25, 2013

(30) Foreign Application Priority Data

Oct. 22, 2011 (DE) ..... 10 2011 116 739
Nov. 22, 2011 (DE) ..... 10 2011 119 112

(51) Int. Cl.

| | |
|---|---|
| ***D01D 5/092*** | (2006.01) |
| ***D01D 5/098*** | (2006.01) |
| ***D04H 3/03*** | (2012.01) |
| ***D04H 3/16*** | (2006.01) |

(52) U.S. Cl.

CPC ..... *D01D 5/0985* (2013.01); *D04H 3/03* (2013.01); *D04H 3/16* (2013.01)
USPC ..... 264/115

(58) Field of Classification Search

CPC ..... D04H 3/03; D04H 3/16
USPC ..... 264/211.2, 280; 425/72.2
See application file for complete search history.

(56) References Cited

U.S. PATENT DOCUMENTS

| | | | | |
|---|---|---|---|---|
| 6,932,590 | B2 | 8/2005 | Gues et al. | |
| 8,231,370 | B2 | 7/2012 | Maas et al. | |
| 2002/0043739 | A1 * | 4/2002 | Locher et al. | 264/172.19 |
| 2009/0321982 | A1 | 12/2009 | Maas et al. | |
| 2010/0062672 | A1 * | 3/2010 | Fare' | 442/409 |

FOREIGN PATENT DOCUMENTS

| | | |
|---|---|---|
| EP | 1 340 842 A1 | 2/2002 |
| WO | WO2008/087193 | 7/2008 |

* cited by examiner

*Primary Examiner* — Galen Hauth
(74) *Attorney, Agent, or Firm* — Brinks Gilson & Lione; G. Peter Nichols

(57) ABSTRACT

An apparatus and a method for guiding and depositing synthetic fibers to form a nonwoven web is described. The apparatus has a drawing device, a deposit belt, and a plurality of guidance means disposed between the drawing device and the deposit belt, which form in pairs numerous merging guidance pathways for the guidance of a fiber curtain formed by the fibers. The guidance means have numerous air intake slits beneath the drawing device, which enable an introduction of a secondary airstream. Numerous air conducting elements disposed on one of the guidance means are associated with at least one of the air intake slits. In this manner at least one of the sub-streams of the secondary airstream laterally adjacent to the fiber curtain can be introduced to the fiber stream at an inflow angle that is at a right angle to the deposit belt.

16 Claims, 5 Drawing Sheets

APPARATUS AND METHOD FOR GUIDING AND DEPOSITING SYNTHETIC FIBERS TO FORM A NONWOVEN WEB

This application is based upon and claims the priority benefit of German Patent Application DE 10 2011 116 739.4 filed Oct. 22, 2011 and of German Patent Application DE 10 2011 119 112.0 filed Nov. 22, 2011, the disclosure of each is hereby incorporated by reference in its entirety.

The invention relates to an apparatus for guiding and depositing synthetic fibers to form a nonwoven fabric or web as well as to a method for guiding and depositing synthetic fibers to form a nonwoven fabric or web.

BACKGROUND

For the production of so-called spunbond nonwoven webs it is generally known that a plurality of extruded fibers, after melt spinning and cooling, are drawn off collectively as a fiber curtain, stretched, and deposited on a deposit belt to form a nonwoven web. The deposited fibers result in a fiber formation within the nonwoven web which, among other things, determines the strength of the nonwoven web. In doing so, the nonwoven web strength is normally determined on a so-called MD axis, and on a so-called CD axis. The MD axis is also the running direction of the belt, in which the nonwoven web is continuously guided after the depositing of the fibers. The CD axis is orthogonal to the MD axis and describes the strength of the nonwoven web at a right angle to the running direction of the belt. Due to the moving during depositing, nonwoven webs of this type are predominantly formed with a depositing oriented on the MD axis. This results in a greater strength of the nonwoven web on the MD axis in relation to the strength on the CD axis. A ratio between MD and CD strengths lies in the region between 1.5 and 3.5, depending on the product setting and the polymer. For the production of technical products, however, spunbonded nonwoven webs having a nonwoven web strength that is distributed equally to the greatest extent possible are required. To influence the fiber formation there are, therefore, various apparatus and methods known in the prior art, for the purpose of obtaining a uniform strength of the nonwoven web to the greatest degree possible in the MD and CD axes.

For example, an apparatus and method for guiding and depositing synthetic fibers to form a nonwoven web is described in WO 2008/087193A2, in which the fiber curtain is drawn off by means of a drawing nozzle and subsequently guided as a fiber stream to a deposit belt. The fiber stream, formed by a primary airstream of the drawing nozzle and the fiber curtain, is conducted through guidance paths formed by a plurality of guidance means disposed in pairs. In this manner, acceleration and spreading of the fiber stream can be generated by means of cross-section changes and constrictions within the guidance pathways, which act in particular on the depositing of the fibers. In addition, air intake slits are formed above the guidance means, beneath the drawing apparatus, which enable the feeding of a secondary airstream. In this manner it is possible to influence the pressure differences in the guidance pathways.

With the known apparatus and with the known method, the depositing of the fiber stream is substantially influenced by means of changes of the cross-section within the guidance pathways and by resulting flow technical effects, in order to obtain a uniform fiber formation within the nonwoven web. However, in this manner it is only possible to influence the fiber stream in a flow direction within the guidance pathways.

A method and an apparatus is known from EP 1 340 842 A1 which shows a drawing apparatus formed by means of a drawing channel, which is connected directly to a cooling device for the fibers. The cooling airstream is used substantially in order to guide the fiber curtain through the drawing channel. A plurality of guidance means are associated with the surface of the drawing channel facing the deposit belt, which form a plurality of merging guidance pathways for the guidance of the fiber stream. The guidance means form numerous air intake slits, through which secondary airstreams are introduced. The guidance means form two merging diffusor-type guidance pathways, such that the fiber stream can be altered by means of cross-section changes and expansions. The depositing of the fibers is therefore also only possible by an influencing the fiber stream in the flow direction. In order to, nonetheless, obtain a distribution of the fibers during depositing that is uniform to the greatest degree possible, a suction device divided into numerous zones is associated with the deposit belt on the undersurface thereof. In this manner, it is possible to generate two different suction effects for receiving the fibers on the upper surface of the deposit belt, having, however, the substantial disadvantage that the fibers are deposited with different intensities and resulting in differing densities of the nonwoven web.

SUMMARY

It is therefore an objective of the invention to provide an apparatus for guiding and depositing synthetic fibers to form a nonwoven web, as well as to provide a method for guiding and depositing synthetic fibers to form a nonwoven web in such a manner that a fiber stream can be generated which results in the fibers obtaining a uniform fiber formation in the running direction of the belt, and at a right angle to the running direction of the belt.

A further aim of the invention is to provide a method and an apparatus for guiding and depositing synthetic fibers to form a nonwoven web, with which a spun nonwoven web for technical applications, having an MD/CD ratio of <1.5, can be produced efficiently and at a high output rate.

This objective is attained according to the invention by means of an apparatus having the characteristics according to the presently described invention and by means of the presently described method. Advantageous developments of the invention are defined by the characteristics and combinations of characteristics as described in the specification.

The invention has the particular advantage that at least on the longitudinal surface of the fiber curtain, along the working width, an airstream can be generated, which in particular, can influence the cross-orientation of the fiber deposit. The sheet according to the invention has, for this purpose, at least on one of the air intake slits, numerous air conducting elements disposed on one of the guidance means. The air conducting elements are associated with the air intake slits, such that the secondary airstream, coming preferably from the surroundings, will assume a flow direction determined by the air conducting elements.

In order to be able to influence the fiber stream over the entire working width of the deposit belt, the design of the apparatus according to the invention is preferably such that the air conducting elements are distributed adjacently, disposed over a width of the deposit belt, and having a uniform spacing or an uneven spacing to one another. The number and distribution of the air conducting elements are arbitrary, whereby the distribution of the air conducting elements extends preferably parallel to the fiber curtain.

To generate cross-streams, which preferably affect the fiber stream at a right angle to the deposit belt, the air conducting elements according to an advantageous design of the invention, have at least one suitable conducting surface, the conducting surface generating a sub-airstream oriented at a right angle to the deposit belt.

The air conducting elements can, for this purpose, be formed by means of profiled bodies and/or obliquely mounted guiding plates. In doing so, the conducting elements can be disposed with differently angled conducting surfaces within the air intake slit. In this manner, the conducting elements associated with the central region of the fiber curtain can be designed, for example, with a more steeply angled conducting surface in relation to the air conducting elements disposed at the edge.

Moreover, there is also the possibility of designing the air conducting elements such that they are adjustable in order to obtain a predefined angular setting of the conducting surfaces depending on the product and the method. For this purpose, the air conducting elements may be designed such that they can be adjusted on the relevant guidance means, wherein the setting of the angular position of the air conducting elements can be carried out separately, or collectively. By this means, the air conducting elements can be set having identical angular positions or with irregular angular positions, in order, for example, to obtain different flow effects during the deposit of the fiber strands in the central region of the working width or at the edge regions of the working width.

In order that the sub-stream of the secondary airstream generated by the air intake slit provides a sub-stream oriented to the flow direction of the fiber stream, the apparatus according to the invention is designed such that the air intake slit is formed between longitudinal guide ends. The longitudinal guide ends are disposed such that they are nested within one another, such that their guide ends are supported in a manner in which they overlap one another in the vertical plane. In this manner, a vertically oriented air intake slit is formed between the guide ends. The spacing between the overlapping guide ends of the guidance means forms a gap width of the air intake slit.

Depending on the desired flow effects, the air conducting elements can, for this purpose, have a guidance height extending into the air intake slit, which is the same size or smaller than the gap width of the air intake slit extending between the guide ends of the guidance means. In this manner, with air conducting elements having the same size, the secondary airstream introduced via the air intake slit can have a plurality of sub-streams that are fed to the fiber stream.

In order to further improve the cross-orientation during the deposit of the fibers, the apparatus according to the invention is designed such that an air intake slit is formed on the opposite guidance means with numerous associated separate air conducting agents at the same height. In this manner it is possible to introduce predetermined secondary airstreams at both sides of the fiber curtain, respectively, which in this manner act on the fibers at both sides of the fiber stream. There is also the possibility of disposing the opposite air conducting elements at different heights on the guidance means.

The opposite air intake slits can be designed with air conducting agents oriented in the same direction, or with air conducting agents oriented in opposite directions, in order to obtain a predetermined effect to the fiber stream for depositing the fibers.

In order that an advantageous vacuum for the suction of the secondary airstream can be generated based on the fiber stream generated in the guidance pathways, the apparatus according to the invention provides the guidance means formed by numerous profiled sheets, which create as a first profiled sheet pair, an intake pathway acting as a diffusor, and as a second profiled sheet pair, form a discharge pathway acting as a diffusor. In this manner, the transition region between the profiled sheet pairs is particularly suited to suction in the desired secondary airstream via an air intake slit. In this respect, the design of the apparatus according to the invention is provided wherein the air intake slits are designed such that each slit has numerous air conducting agents between the two profiled sheet pairs.

For the implementation of higher production speeds in the manufacture of the nonwoven web, it has been proven to be particularly effect to form the drawing device with a drawing nozzle having a guidance channel and numerous nozzle channels opening into the guidance channel, wherein the nozzle channels are connected to a pressurized air source. In this manner, it is possible to generate a primary airstream with the vacuum device, which draws off the fiber curtain after the melt spinning with a greater intensity, and blows said into the downstream guidance pathways while stretching the fiber curtain.

In order to counteract the vacuum existing directly at the discharge end of the drawing nozzle, there are two opposite air intake slits without air conducting agents formed directly beneath the drawing nozzle in the opposing guidance means, wherein the gap widths of the air intake slits are designed such that they can be adjusted. In this manner, the pressure ratios during the generation of the fiber stream can be advantageously influenced in the guidance pathways.

In order to be able to carry out the depositing of the fibers to the greatest degree possible without the further introduction of a secondary airstream, a compensation roller pair is associated with the deposit belt at a belt (discharge) end, wherein a seal is formed between a guide end of the guide means facing the deposit belt and one of the compensation rollers of the compensation roller pair. Furthermore, the nonwoven web can be pre-stiffened via the compensation rollers, wherein the compensation rollers are preferably designed such that they are heated.

At the opposite, intake end, the deposit region above the deposit belt is advantageously shielded from the surroundings by means of a shielding plate, which is connected to one of the guide ends of one of the guidance means facing the deposit belt. In this manner, it is possible to deposit the fiber stream at the discharge end of the guidance means without the effect of a secondary airstream.

To draw off the air, and to support the depositing of the fibers, according to an advantageous design of the invention, the deposit belt has a vacuum box associated with its lower surface. The vacuum box is connected to a vacuum source and has an adjustable suction opening opposite the lower surface of the deposit belt. In this manner, it is possible to generate different vacuums to the upper surface of the deposit belt, depending on the procedure and the method.

The method according to the invention can also be implemented independently of the apparatus according to the invention, in order to influence a fiber stream for depositing the fibers in such a manner that depositing the fibers results in a uniform distribution in the running direction of the belt, and in the direction at a right angle to the running direction of the belt. For this, at least one of the sub-streams of the secondary airstream is fed to the fiber stream, laterally adjacent to the fiber curtain, at an inflow angle that is at a right angle to the deposit belt. By this means, in particular, cross-flowing sub-streams laterally adjacent to the fiber stream can be generated within the guidance pathways, such that a cross-component for the distribution of the fibers acts on the fiber stream.

The effect according to the invention can be advantageously improved in that numerous sub-streams of the secondary airstream are introduced to the fiber stream, parallel to both sides of the fiber curtain, at an inflow angle that is at a right angle to the deposit belt. In this manner, cross-streams that are oriented in the same direction, as well as in opposite directions, can be generated on the fiber curtain.

The sub-streams can be fed to both sides of the fiber curtain, as well as to one side of the fiber curtain with different inflow angles of the fiber stream. In this manner it is possible to adapt the effect of the cross-stream to the respective procedure and type of polymer, as well as the fiber yarn count.

The method according to the invention can be implemented particularly effectively in its variation, in which the sub-stream of the secondary airstream is introduced between two guidance pathways of the fiber stream, each acting as diffusors. In this manner, it is possible to advantageously exploit the pressure ratios acting within the guidance pathways in order to obtain a maximum inflowing secondary airstream.

The secondary airstream is preferably taken from the surroundings. The possibility exists, fundamentally, that the secondary airstream is introduced directly to the air intake slits by means of an additional air source.

The apparatus according to the invention for guiding and depositing synthetic fibers to form a nonwoven web, as well as the method according to the invention for guiding depositing of synthetic fibers to form a nonwoven web shall be described in greater detail in the following, using some embodiments of the apparatus according to the invention.

DETAILED DESCRIPTION

Figure 1:
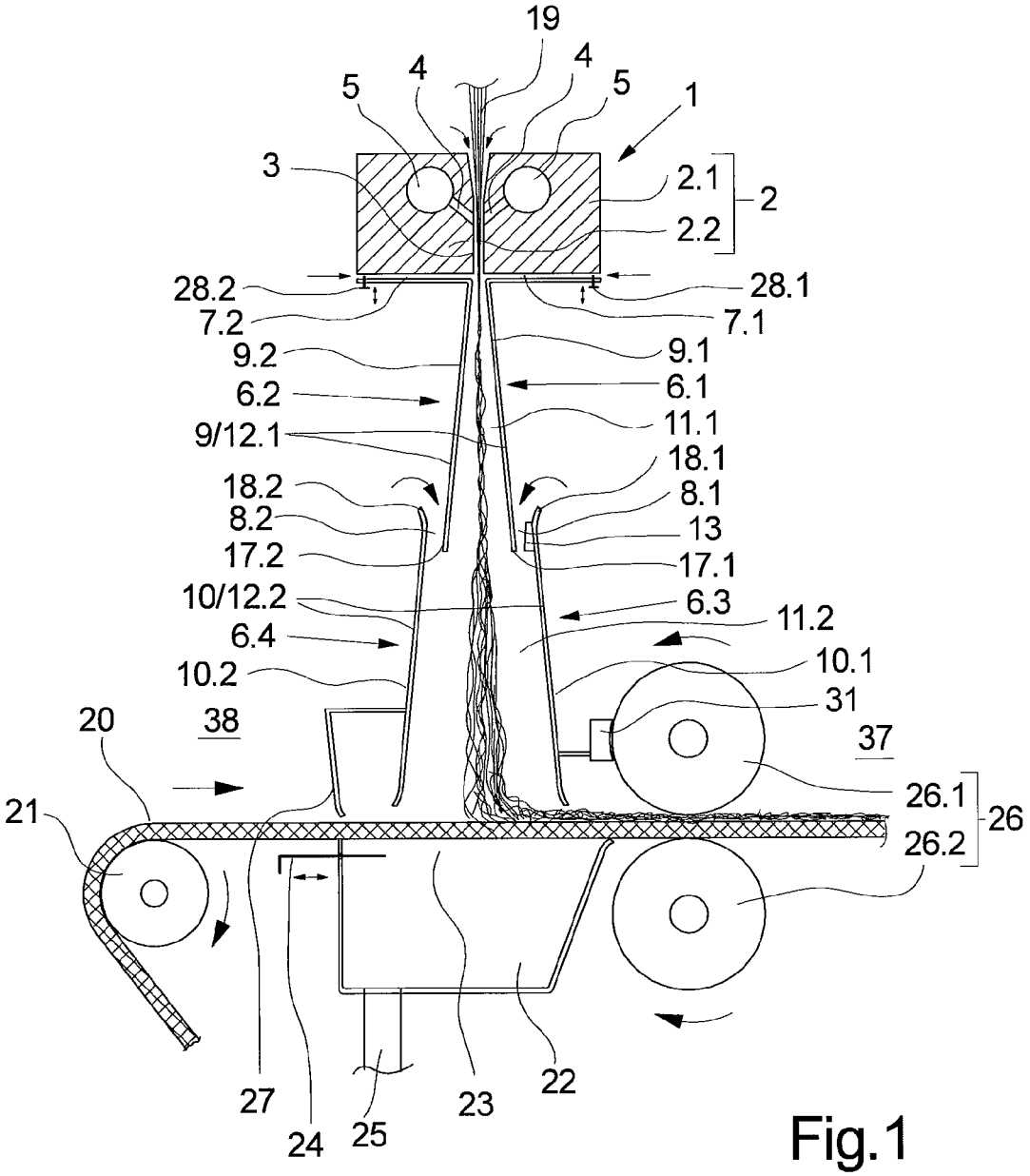
FIG. 1 schematically shows a cross-section view of a first embodiment example of the apparatus according to the invention.
Figure 2:
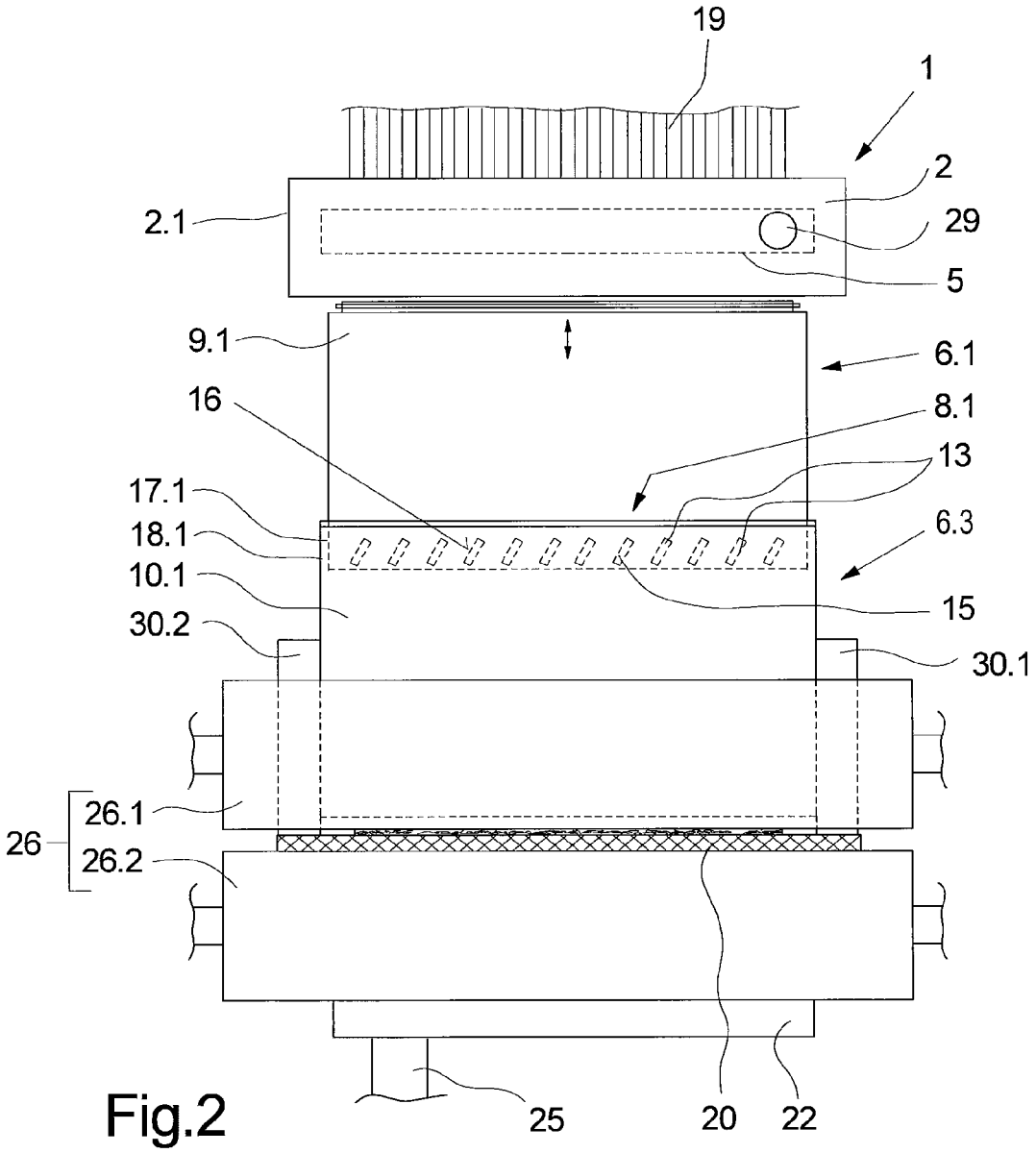
FIG. 2 schematically shows a side view of the embodiment of FIG. 1.

A first embodiment of the apparatus according to the invention for guiding and depositing synthetic fibers to form a nonwoven web is shown in FIGS. 1 and 2. FIG. 1 shows the embodiment schematically in a cross-section view and FIG. 2 shows a side view thereof. Insofar as no express reference is made to one of the figures, the following description applies to both figures.

The embodiment according to FIGS. 1 and 2 has a drawing device 1, for drawing a plurality of fibers extruded by means of a spinning device collectively as a fiber curtain. The fiber curtain is illustrated in FIGS. 1 and 2 and indicated by the reference symbol 19.

The drawing device 1 is formed in this embodiment by a drawing nozzle 2, composed of two nozzle halves 2.1 and 2.2. The nozzle halves 2.1 and 2.2 of the drawing nozzle 2 are disposed parallel to one another and form a central guidance channel 3. Each of the nozzle halves 2.1 and 2.2 contains a pressure chamber 5 and at least one nozzle channel 4 opening into the guidance channel 3. The pressure chambers 5 of the nozzle halves 2.1 and 2.2 are connected by means of pressurized air connections 29 to a pressurized air source, not shown here, such that pressurized air is introduced by means of the nozzle channels 4 into the guidance channel 3.

A deposit belt 20 is disposed beneath the drawing device 1, preferably configured as a continuous belt, driven in a belt running direction via a spindle 21. The belt running direction is indicated by an arrow in FIG. 1. The deposit belt 20 is gas permeable, and can be configured as a screen or as a webbing.

A plurality of guidance means 6.1-6.4 for the formation of numerous merging guidance pathways 11.1 and 11.2 are disposed above the deposit belt 20 between the drawing device 1 and the deposit belt 20. The guidance means 6.1-6.4 are, in each case, disposed in pairs, parallel to the nozzle halves 2.1 and 2.2 of the drawing nozzle 2 in such a manner that between the opposing guidance means 6.1 and 6.2, as well as 6.3 and 6.4, they form guidance pathways 11.1 and 11.2 in the extension of the guidance channels 3.

In this embodiment, the guidance means 6.1 and 6.2 are formed by the profiled sheets 9.1 and 9.2, and the guidance means 6.3 and 6.4 are formed by the profiled sheets 10.1 and 10.2. The profiled sheet pair 9 of the profiled sheets 9.1 and 9.2 defines an intake path 11.1, designed as a diffusor 12.1, and the profiled sheet pair 10 of the profiled sheets 10.1 and 10.2 defines a discharge path 11.2, designed as a diffusor 12.2. The guide ends 17.1 and 17.2 of the profiled sheets 9.1 and 9.2, as well as the guide ends 18.1 and 18.2 of the profiled sheets 10.1 and 10.2 are disposed such that they overlap, and each form an air intake slit 8.1 and 8.2 between them. The overlapping guide ends 17.1 and 17.2 as well as 18.1 and 18.2 respectively form vertically oriented air intake slits 8.1 and 8.2, the gap width of which is determined by the spacing of the guide ends 17.1 and 18.1, as well as 17.2 and 18.2.

In this embodiment, The air intake slit 8.1 formed at a discharge end 37 between the guidance means 6.1 and 6.3 has numerous air conducting elements 13. The air conducting elements 13 are disposed on the upper guide end 18.1 of the guidance means 6.3 and extend with a conducting surface 16 into the air intake slit 8.1.

As can be seen in FIG. 2, a plurality of air conducting elements 13 are evenly disposed over the width of the deposit belt 20 on the upper guide end 18.1 of the profiled sheet 10.1. In each case, a uniform spacing is formed between the air conducting elements 13. The air conducting elements 13 are formed in this embodiment by a longitudinal profiled body 15, the upper surface of which forms an angled conducting surface 16. The angle of the molding 15 is uniformly oriented over the entire width of the deposit belt 20 in this embodiment.

As can be seen in the depiction in FIGS. 1 and 2, two more opposing air intake slits 7.1 and 7.2 are formed, in each case directly beneath the drawing nozzle 2, between the drawing nozzle 2 and the adjacent guidance means 6.1 and 6.2. An air flap 28.1 and 28.2 is associated with each of the air intake slits 7.1 and 7.2, respectively, by means of which an opening cross-section of the air intake slits 7.1 and 7.2 can be adjusted with respect to its size.

At the opposite ends of the guidance means 6.3 and 6.4, the deposit belt 20 is disposed at a short distance from the guidance ends 6.3 and 6.4. Sealing elements are provided in each case at the intake end 38 and the discharge end 37 of the deposit region for the fibers of the fiber curtain, formed thereby between the profiled sheet pair 10 and the deposit belt 20. The upper surface of the deposit belt 20 is protected from the exterior at the intake end 38 by means of a shielding plate 27, which is attached to the profiled sheet 10.2. A compensation roller pair 26 is associated with the deposit belt 20 at the discharge end 37, wherein one of the compensation rollers 26.1 is disposed on the upper surface of the deposit belt 20 and the opposing compensation roller 26.2 is disposed on a lower surface of the deposit belt. A sealing strip 31 is disposed on the upper surface of the deposit belt 20 between the compensation roller 26.1 and the profiled sheet 10.2, such that the deposit region on the upper surface of the deposit belt 20 is protected from the exterior.

Depending on the design of the ends of the profiled sheet pairs 10, there is, however, also the possibility to configure the deposit region without an additional shielding means at the intake end 38 and without an additional sealing strip at the discharge end.

As can be seen in particular in the depiction in FIG. 2, the lateral surfaces of the profiled sheets 10.1 and 10.2 are protected from the exterior in the deposit region of the deposit belt 20 by means of sealing plates 30.1 and 30.2. In this respect, the deposit region at the upper surface of the deposit belt 20 is substantially shielded from the exterior.

As can be seen in the depiction in FIG. 1, a vacuum box 22 is disposed adjacent the lower surface of the deposit belt 20, which directly subjects the lower surface of the deposit belt 20 to suction in the region of the fiber deposit via a suction opening 23. The vacuum box 22 is connected for this purpose by means of a suction connection 25 to a vacuum source, not shown here. An adjustable flap 24 is associated with the suction opening 23 in this embodiment, so that the size of suction opening 23 can be altered.

When in operation, the embodiment of the apparatus according to the invention depicted in FIGS. 1 and 2 is combined with a spinning device, not shown here. The spinning device can be designed to have a nozzle block with numerous nozzle holes disposed in a row, and a cooling device located beneath the nozzle block. The fibers generated in the spinning device are guided as a fiber curtain 19 and drawn into the guidance channel 3 by means of the drawing nozzle 2. The fibers of the fiber curtain 19 are blown out of the guidance channel 3 together with the primary airstream generated by the drawing nozzle 2 as a fiber stream, and blown into the adjacent intake pathway 11.1 of the profiled sheets 9.1 and 9.2. As a result of the high flow rates, a vacuum results, which draws a secondary airstream from the surroundings via the air intake slits 7.1 and 7.2 at the lower surface of the drawing nozzle 2. The inflowing secondary airstream can be adjusted in a continuously variable manner by means of adjusting the air intake slits 7.1 and 7.2 with the adjustment flaps 28.1 and 28.2, respectively. The flow rate of the fiber stream is increased at a narrow cross-section of the intake pathway 11.1, designed as a diffusor, by means of the secondary airstream that has been introduced, and subsequently slowed by means of the cross-section expansion between the profiled sheets 9.1 and 9.2. Upon exiting the intake pathway 11.1, a secondary airstream is again drawn in via the air intake slits 8.1 and 8.2. In doing so, the secondary airstream drawn in via the air intake slit 8.1 is guided by means of the air conducting elements 13 in the direction corresponding to the orientation of the air conducting elements 13. In this manner, with the inflowing of the secondary airstream through the respective conducting surfaces 16 of the air conducting elements 13, a sub-stream laterally adjacent to the fiber curtain 19 is generated at a right angle to the deposit belt 20, which acts on the fiber stream as a secondary airstream. The cross-flows of the inflowing secondary airstream acting on the fiber stream result in a deflection of the fibers and causes an improved cross-orientation when depositing the fibers.

The fiber stream is slowed by means of the cross-section expansion between the profiled sheets 10.1 and 10.2, and deposited directly on the deposit belt. The spacing between the profiled sheets 10.1 and 10.2, and the deposit belt 20 is set in this embodiment example to a predetermined spacing. This spacing can, however, be advantageously designed to be adjustable, such that, depending on the procedure and the polymer, a predetermined spacing between the discharge end of the guidance means 6.3 and 6.4, and the deposit belt 20 can be adjusted.

The depositing of the fiber stream and the uptake of the surplus air is supported thereby through the suction effect of the vacuum box 22. The suction opening 23 is set for this purpose at a predetermined range, such that a defined formation range for depositing the fibers is obtained.

The intake of further secondary airstreams is prevented by means of the shielding plate 27 on the intake end 38 and the sealing strip 31, as well as the compensation roller 26.1. In this respect, depositing of the fibers is determined by means of the fiber stream, which is composed of the primary airstream and the added sub-streams of the secondary airstream. Important for this is that at least one of the sub-streams of the secondary airstream is introduced to the fiber stream laterally adjacent to the sheet at a stream angle that is at a right angle to the deposit belt. The fiber steam can be influenced for the generation of a predefined fiber orientation by mean of this sub-stream, directed at a right angle to the deposit belt 20, in a such manner that the strength of the nonwoven web generated thereby is made uniform to a high degree, such that the nonwoven web exhibits a nearly uniform strength on both the MD axis and the CD axis. The nonwoven webs generated in this manner are therefore particularly suited for use as, for example, filter substrates, tensioned underlay strips or geotextiles. The nonwoven webs produced in this manner are distinguished by an MD/CD ratio in the range of 1.0-1.5.

Figure 3:
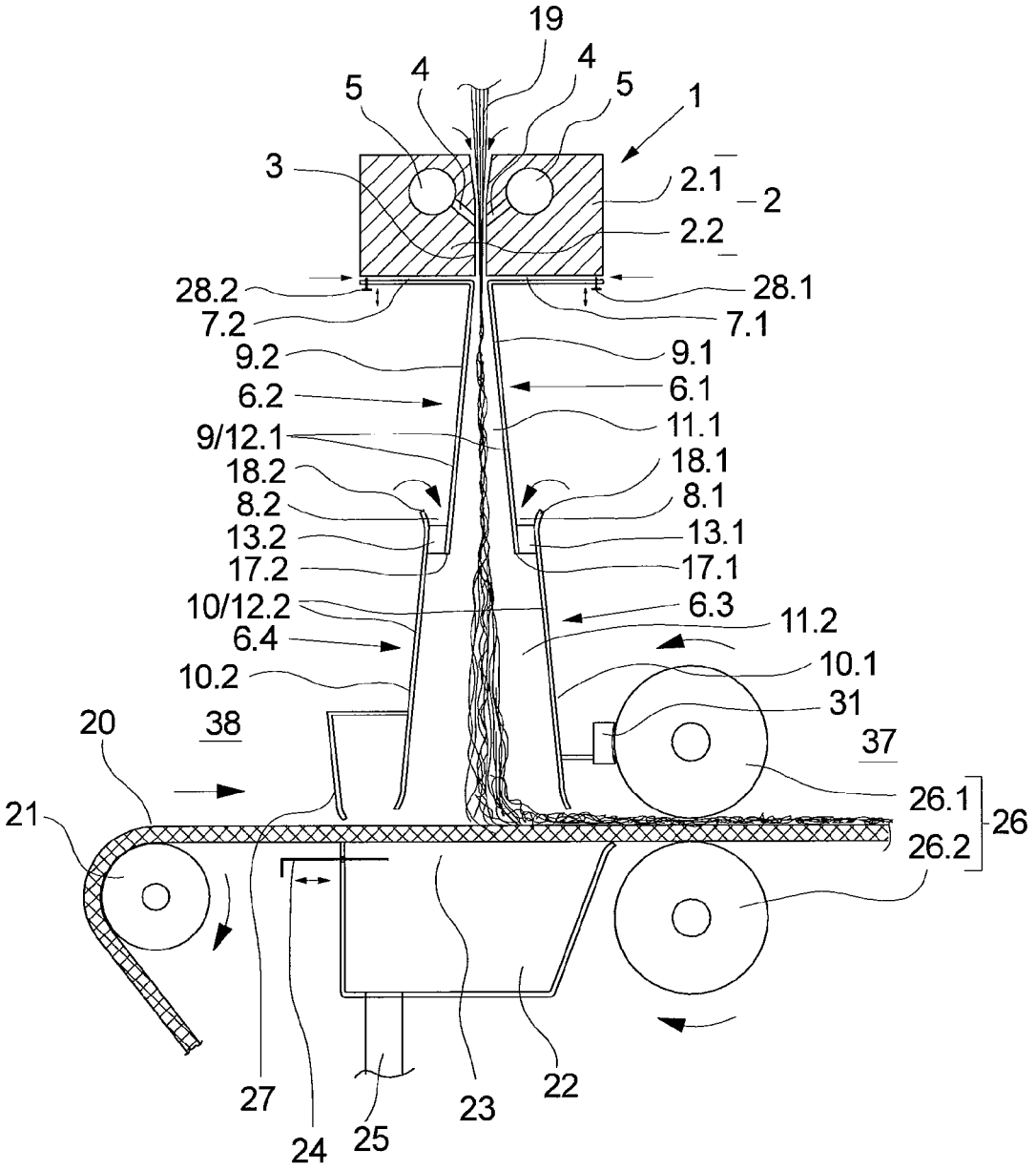
FIG. 3 schematically shows a cross-sectional view of another embodiment of the apparatus according to the invention.

The embodiment depicted in FIG. 3 is particularly suited to obtaining nearly equal strengths in both the running direction of the belt and at a right angle to the running direction of the belt. The embodiment according to FIG. 3 is substantially identical to the embodiment according to FIGS. 1 and 2, such that at this point only the differences shall be explained and otherwise, reference shall be made to the aforementioned description.

In the embodiment depicted in FIG. 3, the opposing air intake slits 8.1 and 8.2 are executed in each case with air conducting elements 13.1 and 13.2 between the profiled sheet pairs 9 and 10. In this manner, the secondary airstream drawn in at the intake end 38 and the secondary airstream suctioned in at the discharge end 37 can be advantageously guided by means of the conducting elements 13.1 and 13.2 such that at both sides of the fiber curtain, the sub-stream of the secondary airstream can be fed into the fiber stream at specific inflow angles that are at a right angle to the deposit belt. The air conducting elements 13.1 and 13.2 associated with the air intake slits 8.1 and 8.2 can be designed here to be identical, as conducting plates or moldings, for example.

In the embodiment according to FIGS. 1-3, the drawing nozzle 2 and the guidance means 6.1-6.4 are normally mounted in a machine frame. The flexibility for the manufacturing of different nonwoven webs and for the processing of different products can be increased to an even greater extent if the drawing nozzle and the guidance means 6.1-6.4 are mounted in such a manner that their respective heights can be adjusted. In this manner, a spacing formed between the drawing nozzle 2 and the deposit belt 20 can be altered. Likewise, a vertical spacing of the profiled sheet pairs 9 and 10 can also be adjustable. In addition, the profiled sheets 9.2 and 10.2 disposed on the intake end 38 are connected to a nozzle half of the drawing nozzle 2 in such a manner that they can be directed back and forth between an operational position and a maintenance position. In the maintenance position, the nozzle halves of the drawing nozzle 2 and the profiled sheets 9.2 and 10.2 are held such that a cleaning of the guidance channel 3 as well as a start-up of the procedure is possible.

Figure 4:
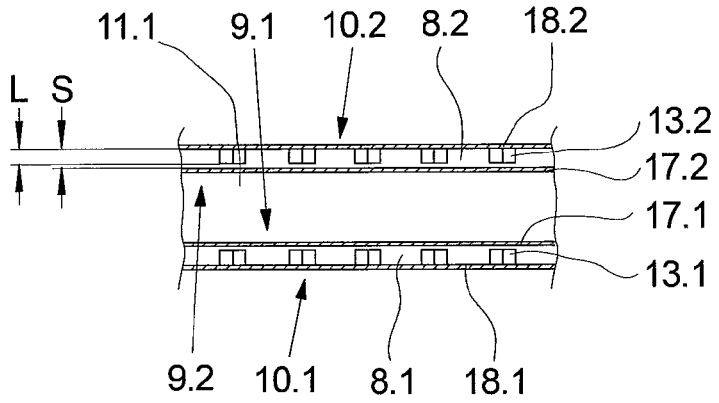
FIG. 4 schematically shows a sectional depiction of opposite lying guidance means having air intake slits.
Figure 5:
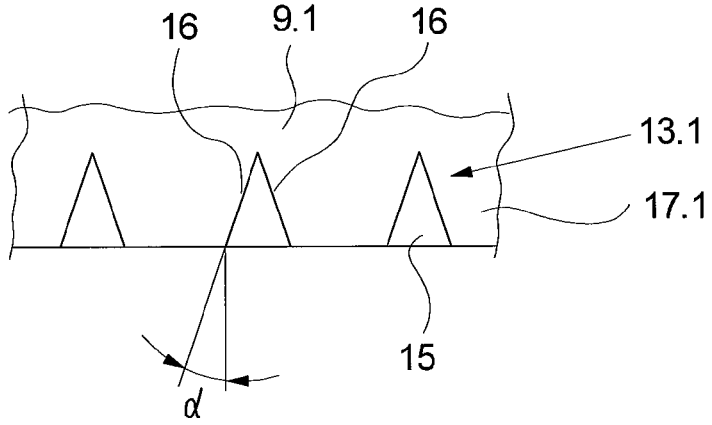
FIG. 5 schematically shows a view of one of the guidance means in FIG. 4.

An embodiment of a possible execution of the air intake slits 8.1 and 8.2 is schematically depicted in FIGS. 4 and 5. FIG. 4 schematically shows a sectional portion of the air intake slits 8.1 and 8.2 in the profiled sheet pairs 9 and 10, and FIG. 5 shows a view of a guide end 17.1 of one of the profiled sheets 9.1 having air conducting elements 13.1 disposed thereon.

As can be seen from FIG. 4, the air conducting elements 13.1 in the air intake slit 8.1 and in the air intake slit 8.2 are identical in design. The air conducting elements 13.1 and 13.2 have a guidance height extending into the air intake slits 8.1 and 8.2, which is less than the gap width of the air intake slits 8.1 and 8.2. The guidance height of one of the air conducting elements 13.2 is defined in FIG. 4 with the reference symbol L. The gap width of the dedicated air intake slit 8.2 is indicated by the reference symbol S. Therefore, in this embodiment example, S>L.

The relation between the guidance height S and the gap width L can also be advantageously adjusted by means of movable outer guide ends 18.1 and 18.2 of the profiled sheets 10.1 and 10.2, or by means of movable inner guide ends 17.1 an 17.2 of the profiled sheets 9.1 and 9.2, wherein the air conducting elements 13.1 and 13.2 act as stops, in order to obtain a setting where S=L. In this manner, the air conducting elements 13.1 and 13.2 extend over the entire spacing between the profiled sheets 9.1 and 10.1, and the profiled sheets 9.2 and 10.2.

As can be seen in FIG. 5, the air conducting elements 13.1 and 13.2 are each executed as profiled bodies 15 having a triangular shape. In this respect, each of the profiled bodoes 15 has two diagonal conducting surfaces 16, which in relation to a vertical inflow direction of the secondary airstream, form an inflow angle a. The inflow angle a is oriented at a right angle to the flow direction of the fiber stream, and thus generates an orientation of the fibers within the fiber stream directed at a right angle to the deposit belt. This flow effect generated by means of the conducting elements 13.1 and 13.2 can, depending on the design of the conducting elements 13.1 and 13.2, be advantageously used in order to influence the fiber stream in accordance with the desired deposit.

Figure 6:
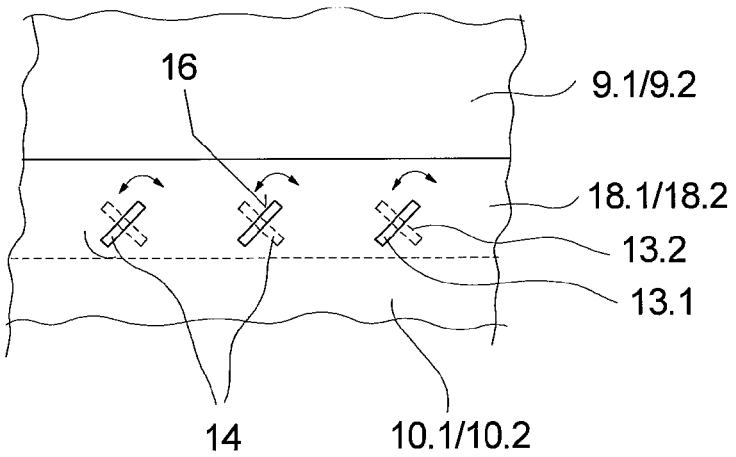
FIG. 6 schematically shows a side view of a guidance means having air conducting elements.

It is also possible for the air conducting elements 13.1 and 13.2 to be disposed in the air intake slits 8.1 and 8.2 with opposing orientations. Thus, in FIG. 6 an embodiment is shown in which numerous air conducting elements 13.1 and 13.2 in the form of conducting plates 14 are disposed at a spacing to one another, disposed on the upper guide ends 18.1 and 18.2 of the profiled sheets 10.1 and 10.2. The conducting plates 14 have a diagonal conducting surface for the guidance of the suctioned-in secondary airstream. The conducting elements 13.1 disposed on the guide end 18.1 of the profiled sheet 10.1 are depicted by solid lines. The air conducting elements 13.2 that are not visible and are disposed in the air intake slit 8.2 behind this, at the guide end 18.2 of the profiled sheet 10.2, are depicted by broken lines, and have an opposite angling of the conducting surfaces 16. In this respect, differently oriented sub-streams of the secondary airstream are generated on both sides of the fiber curtain, which act accordingly on the fiber stream.

The angular position of the conducting plate 14 can be adjusted in this embodiment, such that the inflow angle formed by the conducting plate 14 can be altered. The adjustment mechanism can be designed for this purpose such that all of the conducting plates 14 mounted at one guide end, 18.1 or 18.2, can be collectively adjusted to the desired angular position. The adjustment mechanism could, however, also allow for an individual adjustment to the conducting plates 14, such that individual adjustments to each conducting plate would be possible.

The method according to the invention and the apparatus according to the invention offer in this manner a high degree of flexibility for individual effects to the fiber stream, in order to obtain a desired fiber orientation with the depositing of the fibers.

Figure 7:
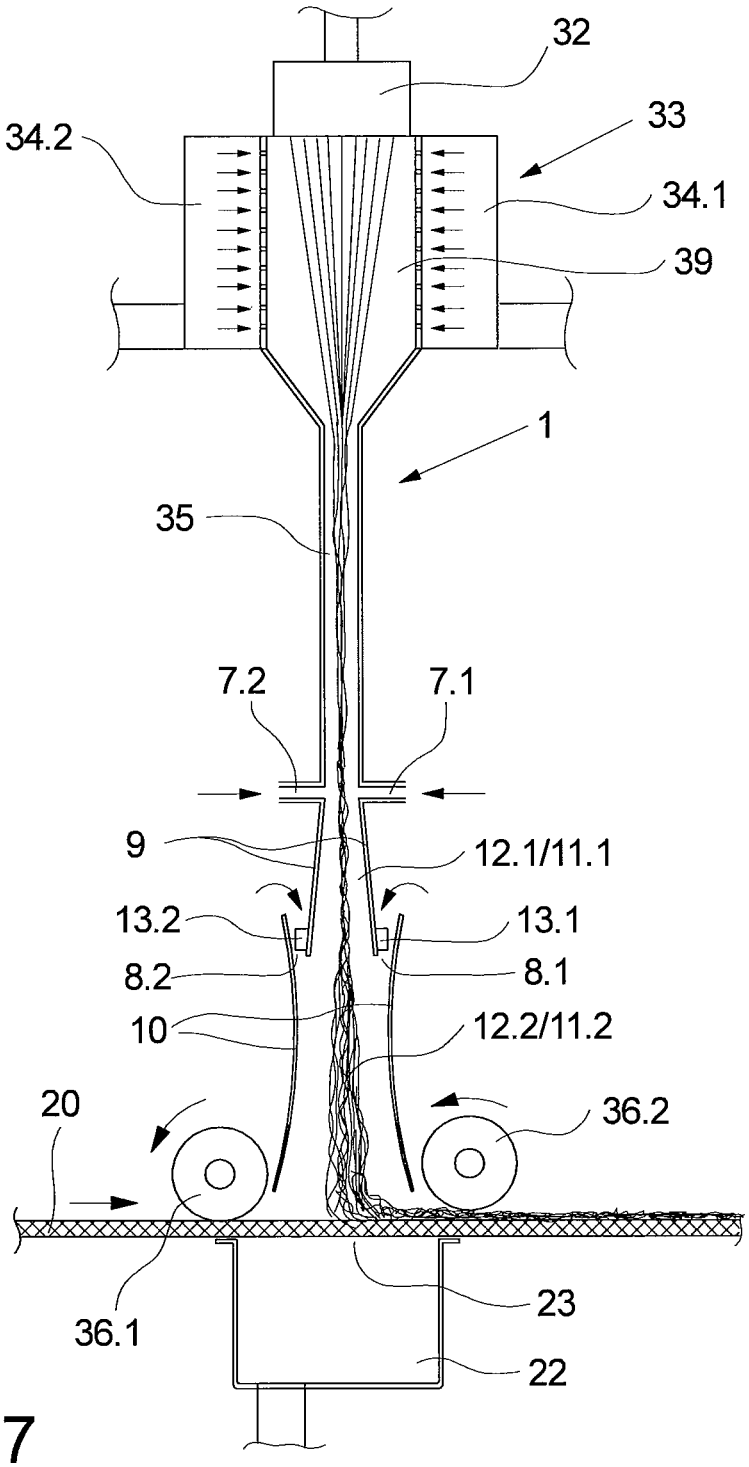
FIG. 7 schematically shows a cross-sectional view of another embodiment of the apparatus according to the invention.

In FIG. 7 another embodiment of the apparatus according to the invention together with a spinning device is depicted. For the embodiment example depicted in FIG. 7 only a cross-section view is depicted.

The embodiment according to FIG. 7 has a heatable spinning beam 32, having a longitudinal spinning nozzle with a plurality of nozzle bores on its lower surface. The spinning nozzle is not shown here. A cooling device 33 is provided beneath the spinning beam 32, having two pressure chambers 34.1 and 34.2 laterally adjacent to the spinning beam 32, which each form a spinning shaft by means of a blow wall.

A drawing device 1 is disposed beneath the cooling device 33, which forms a drawing channel 35 as an extension of the spinning shaft 39. The drawing channel 35 is connected to the cooling device 33 in a sealed manner, such that the cooling airstream of the cooling device 33 is guided, together with the fiber curtain, through the drawing channel 35. A plurality of profiled sheet pairs 9 and 10 are disposed at the discharge end of the drawing channel 35, between which, in each case, a diffusor 12.1 and 12.2 is formed. The air intake slits 7.1 and 7.2 are formed between the drawing device 1 and the first profiled sheet pair 9, through which the inflow of a secondary airstream can be regulated. Further downstream in the guidance pathways 11.1 and 11.2, other air intake slits 8.1 and 8.2 are formed between the first diffusor 12.1 and the second diffusor 12.2, to each of which numerous air conducting elements 13.1 and 13.2 are dedicated. The function and design of the air conducting elements 13.1 and 13.2 in the air intake slits 8.1 and 8.2 is identical to those in the aforementioned embodiment, such that at this point, no further explanation is deemed necessary.

The deposit region is sealed by means of two sealing rollers 36.1 and 36.2 on the upper surface of the deposit belt at the ends of the profiled sheets 10.1 and 10.2 facing away from the deposit belt 20. Between the sealing rollers 36.1 and 36.2, a vacuum box 22 is provided on the lower surface of the deposit belt 20, which is connected to a suction opening 23 and a vacuum source, not depicted therein. The deposit belt 20 is also configured in this embodiment to be gas permeable, and as a continuous belt, driven by means of a drive, not shown here, in the running direction of the belt. In order to improve the seal, the sealing rollers 36.1 and 36.2 can also have sub-rollers, which are mounted accordingly on the lower surface next to the vacuum box 22.

With the embodiment depicted in FIG. 7, the generation of the primary airstream is substantially obtained by means of the cooling airstream. Thus, the fiber stream generated by means of the drawing device 1 is formed by the cooling airstream and the fiber curtain, which is influenced in the downstream course of the guidance of the fiber stream by the secondary airstream introduced thereto.

The guidance means for generating one or more guidance pathways of the fiber stream used in the depicted embodiment are exemplary. It is contemplated that any molded profiled sheet could be used as a guidance means, or rollers, or other shielding means may be used for the formation of the guidance pathways. In other words, any suitable configuration that provides that a secondary airstream suctioned in through an air intake slit is deflected by means of suitable air conducting elements in such a manner that a sub-stream of the secondary airstream flows at a right angle to the deposit belt, and thereby has an effect in the fiber stream in the depositing of the fibers.

Furthermore, in the depicted embodiments, the secondary airstream is, in each case, generated from the surroundings. The possibility exists, fundamentally, that in the shown embodiments, an additional airstream source is connected to one or both of the air intake slits containing the air conducting elements. In this respect, it is also possible to actively introduce the secondary airstream by means of an airstream source.

REFERENCE SYMBOL LIST

1 drawing device
2 drawing nozzle
2.1 nozzle half
2.2 nozzle half
3 guidance channel
4 nozzle channel
5 pressure chamber
6.1, 6.2, 6.3, 6.4 guidance means
7.1, 7.2 air intake slit
8.1, 8.2 air intake slit
9 profiled sheet pair
9.1, 9.2 profiled sheet
10 profiled sheet pair
10.1, 10.2 profiled sheet
11.1, 11.2 guidance pathway
12.1, 12.2 diffusor
13, 13.1, 13.2 air conducting element
14 conducting plate
15 molding
16 conducting surface
17.1, 17.2 guide end
18.1, 18.2 guide end
19 fiber curtain
20 deposit belt
21 belt spindle
22 vacuum box
23 suction opening
24 adjustment flap
25 suction connection
26 compensation roller pair
26.1, 26.2 compensation roller
27 shielding plate
28.1, 28.2 air flaps
29 pressurized air connection
30.1, 30.2 sealing plate
31 sealing strip
32 spinning beam
33 cooling device
34.1, 34.2 pressure chamber
35 drawing channel
36 sealing roller
37 discharge end
38 intake end
39 spinning shaft

What is claimed:

1. An apparatus for guiding and depositing synthetic fibers to form a nonwoven web comprising:

a drawing device having a drawing nozzle with a deposit belt disposed beneath the drawing device;

a plurality of opposed guiding sheets disposed between the drawing device and the deposit belt, which form, in pairs, a plurality of merging guidance pathways for jointly guiding a fiber curtain formed by the fibers and a primary airstream generated by the drawing nozzle, wherein the plurality of opposed guiding sheets define a plurality of air intake slits beneath the drawing device, which enable an introduction of a secondary airstream; and a plurality of air guiding elements disposed on one of the guiding sheets and associated with at least one of the air intake slits.

2. The apparatus according to claim 1 wherein the air guiding elements are distributed over a width of the deposit belt and, disposed with a uniform spacing or an uneven spacing in relation to one another.

3. The apparatus according to claim 1 wherein the air guiding elements have at least one conducting surface, wherein the one conducting surface generates a sub-stream oriented at a right angle to the deposit belt with the inflow of a secondary airstream.

4. The apparatus according to claim 3 wherein the air guiding elements are formed by means of profiled bodies or by means of obliquely mounted conducting plates.

5. The apparatus according to claims 1 wherein the air guiding elements are mounted on one of the guiding sheets in such a manner that they can be adjusted with respect to their angular position.

6. The apparatus according to claim 1 wherein the air intake slit is formed between two longitudinal guide ends of two guiding sheets configured such that the guide ends of the guiding sheets vertically overlap.

7. The apparatus according to claim 6 wherein the air guiding elements have a height that is the same or less than a gap width of the air intake slit extending between the guide ends of the guiding sheets.

8. The apparatus according to claim 1 wherein a plurality of separate air guiding elements are disposed at the same height to one of the air intake slits.

9. The apparatus according to claim 8 further comprising opposing air intake slits formed with air guiding elements oriented in the same direction, or with air guiding elements oriented in opposing directions.

10. The apparatus according to claim 1 wherein the plurality of guiding sheets includes a first profiled sheet pair designed as an intake path and a second profiled sheet pair designed as a discharge path.

11. The apparatus according to claim 10 wherein the air intake slits have a plurality of air guiding elements between the two profiled sheet pairs.

12. The apparatus according to claim 1 wherein the drawing device is connected to a pressurized air source through a drawing nozzle having a guidance channel and a plurality of nozzle channels opening into the guidance channel.

13. The apparatus according to claim 12 wherein the plurality of opposed guiding sheets form two opposing air intake slits having adjustable gap widths without air guiding elements directly beneath the drawing nozzle.

14. The apparatus according to claim 1 further comprising a roller pair associated with the deposit belt at a belt discharge end wherein a seal is formed between a guide end of the guiding sheets facing the deposit belt and one of the rollers of the roller pair.

15. The apparatus according to claim 14 further comprising a shielding plate connected to one of the guide ends of the guiding sheets facing the deposit belt at an intake end.

16. The apparatus according to claims 1 further comprising a vacuum box associated with a lower surface of the deposit belt and being connected to a vacuum source wherein the vacuum box includes an adjustable suction opening opposite the lower surface of the deposit belt.

* * * * *